US010029487B2

(12) United States Patent
Allen et al.

(10) Patent No.: US 10,029,487 B2
(45) **Date of Patent: *Jul. 24, 2018**

(54) ADA/BRAILLE-COMPLIANT SIGNAGE PRINTER AND A METHOD OF PRINTING UV-CURABLE INK USING AN INK JET PRINTER

(71) Applicant: DIRECT COLOR LLC, Rocky Hill, CT (US)

(72) Inventors: Blair Allen, Cromwell, CT (US); Bill Allen, Kensington, CT (US); Steve Chamberland, Berlin, CT (US); Lawrence Erikson, Glastonbury, CT (US); Matthew Sands, Rocky Hill, CT (US)

(73) Assignee: Direct Color LLC, Rocky Hill, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,217

(22) Filed: Aug. 25, 2017

(65) Prior Publication Data

US 2017/0348985 A1 Dec. 7, 2017

Related U.S. Application Data

(63) Continuation of application No. 15/358,111, filed on Nov. 21, 2016, now Pat. No. 9,757,961, which is a continuation-in-part of application No. 14/780,346, filed as application No. PCT/US2014/031865 on Mar. 26, 2014, now Pat. No. 9,498,977.

(60) Provisional application No. 61/805,263, filed on Mar. 26, 2013.

(51) Int. Cl.
*B41J 2/01* (2006.01)
*B41J 11/00* (2006.01)

(52) U.S. Cl.
CPC ..... *B41J 11/002* (2013.01); *B41J 2/01* (2013.01)

(58) Field of Classification Search
CPC ..... B41J 2/01; B41J 11/002
See application file for complete search history.

(56) References Cited

U.S. PATENT DOCUMENTS

| | | | | |
|---|---|---|---|---|
| 6,164,850 | A | 12/2000 | Speakman | |
| 9,757,961 | B2 * | 9/2017 | Allen | B41J 3/32 |
| 2008/0179786 | A1 | 7/2008 | Sperry et al. | |
| 2009/0148621 | A1 | 6/2009 | Kritchman et al. | |
| 2012/0105534 | A1 | 5/2012 | Boday et al. | |

(Continued)

FOREIGN PATENT DOCUMENTS

KR 101166660 B1 7/2012

OTHER PUBLICATIONS

International Search Report and Written Opinion dated Aug. 22, 2014, for PCT Application No. PCT/US2014/031865.

(Continued)

*Primary Examiner* — Lamson Nguyen
(74) *Attorney, Agent, or Firm* — Kinney & Lange, P.A.

(57) ABSTRACT

A printer includes a table configured to hold a substrate, an ink jet dispenser carried by a print head and configured to jet UV-curable ink onto the substrate in a target region, and a UV curing system configured to emit UV irradiance in a radiation field that covers the target region and provides sufficient intensity to at least pin the UV-curable ink in the target region.

19 Claims, 10 Drawing Sheets

(56) References Cited

U.S. PATENT DOCUMENTS

| | | | |
|---|---|---|---|
| 2012/0194616 | A1 | 8/2012 | Van Dyck et al. |
| 2012/0210934 | A1 | 8/2012 | Nakamura et al. |

OTHER PUBLICATIONS ntemational Preliminary Report on Patentability dated Sep. 29, 2015, for PCT Application No_ PCT/ 52014/031865.

* cited by examiner

ADA/BRAILLE-COMPLIANT SIGNAGE PRINTER AND A METHOD OF PRINTING UV-CURABLE INK USING AN INK JET PRINTER

CROSS-REFERENCE TO RELATED APPLICATIONS

This application is a continuation of U.S. application Ser. No. 15/358,111 filed Nov. 21, 2016, which in turn is a continuation-in-part of U.S. application Ser. No. 14/780,346 filed Sep. 25, 2015, which in turn is the national phase of PCT Application No. PCT/US2014/031865 filed Mar. 26, 2014, which in turn claims the benefit of U.S. Provisional Application No. 61/805,263 filed Mar. 26, 2013.

INCORPORATION BY REFERENCE

The aforementioned U.S. application Ser. No. 15/358,111 and Ser. No. 14/780,346, PCT Application No. PCT/US2014/031865 and U.S. Provisional Application No. 61/805,263 are hereby incorporated by reference in their entirety.

BACKGROUND

The present invention relates to the technical field of sign manufacturing, and in particular manufacture of signs that are ADA compliant, such as Braille signs that conform to ADA rules on dot spacing, height, and finish. Previously known technologies in the art include use of photopolymer, engraving/routing, and similar techniques and technologies.

In general, greater printing height and dot placement accuracy are desirable. Printing height is generally limited by the type of ink used, as low-viscosity inks may wet out across the printing substrate. Likewise, dot placement accuracy may be negatively affected by wetting of the printed ink. Known technologies utilize UV curable ink, which may be dispensed easily and cured on the substrate.

SUMMARY

A printer includes a table configured to hold a substrate, an ink jet dispenser carried by a print head and configured to jet UV-curable ink onto the substrate in a target region, and a UV curing system configured to emit UV irradiance in a radiation field that covers the target region and provides sufficient intensity to at least pin the UV-curable ink in the target region.

DETAILED DESCRIPTION

An improved printer is described herein that reduces or eliminates several inefficiencies of previously known Braille printers. For example, printers incorporating the invention can produce ADA-compliant signage using fewer passes, resulting in faster printing. Furthermore, by reducing the number of passes of the print head, accuracy of dot placement of Braille or other ADA-compliant signage can be increased.

Figure 1:
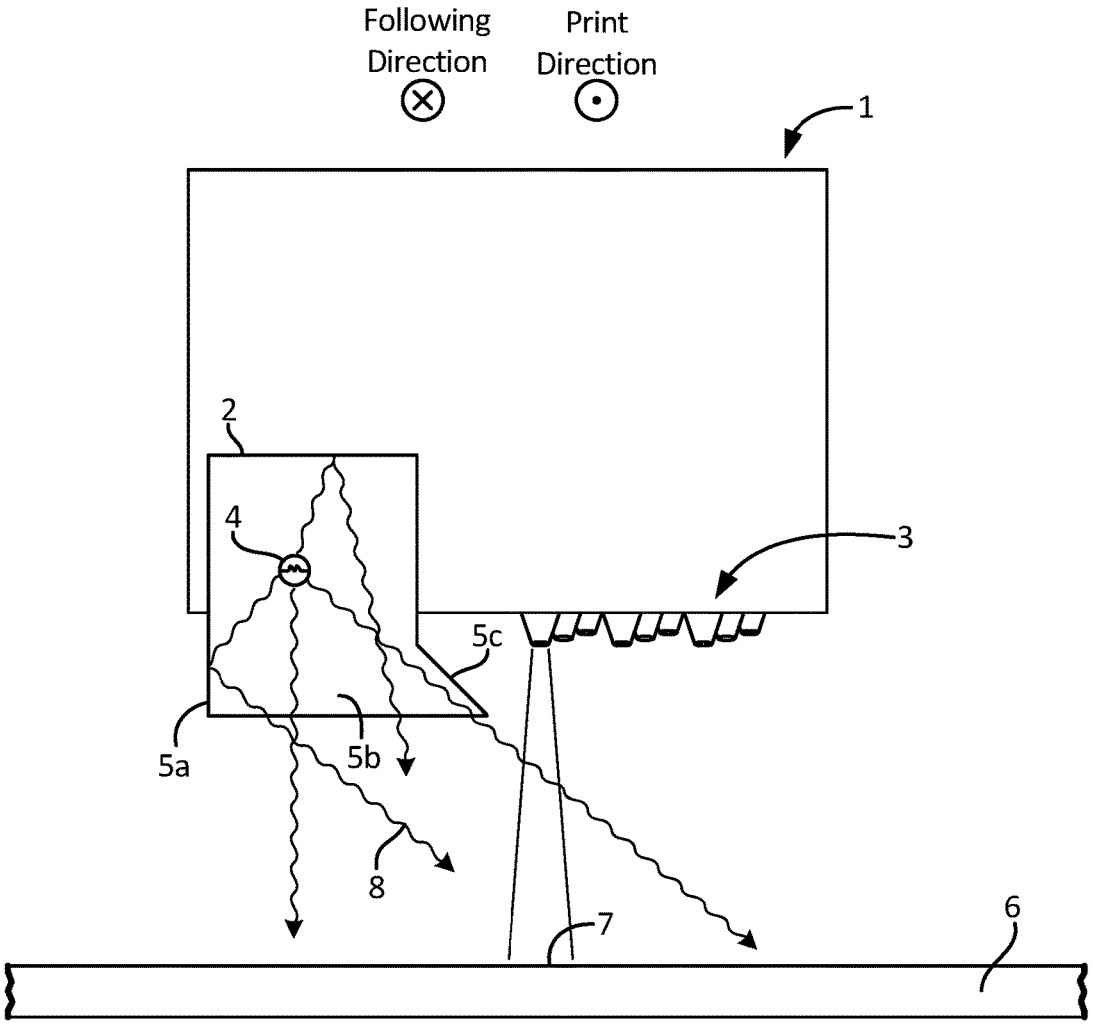
FIG. 1 is a schematic cross-sectional view of an inkjet printer.

FIG. 1 is a schematic cross-sectional view of print head 1, including UV curing system 2 and print nozzles 3. UV system 2 includes UV bulb 4, following direction mirror 5*a*, side mirrors 5*b*, and print direction mirror 5*c*. Print head 1 is arranged above substrate 6, such that UV system 2 and nozzles 3 are configured to print on a target area 7 associated with each of the nozzles 3.

Print head 1 can be used to generate printed materials such as ADA-compliant and/or Braille signage. Dot spacing, height, and finish of printed material are dependent on the capabilities of print head 1. Print head 1 is capable of producing signage with accurate dot spacing, using a controlled number of passes to create a desired height.

UV system 2 is a curing system used to cure a UV ink (not shown) dispensed from print nozzles 3. For clarity, only some of print nozzles 3 are shown in FIG. 1. Print nozzles 3 may extend across substantially the entire width of print head 1. In all, print head 1 may include several thousand print nozzles 3. Print nozzles 3 are arranged in the print direction relative to UV system 2.

Print nozzles 3 can be, for example, piezo dispensers, or more particularly micro piezo dispensers. Micro piezo technology is based on the phenomenon of piezoelectricity where materials like crystals and ceramics (known as "piezoelectric materials") react physically by bending, vibrating or expanding when an electrical charge is applied to them. Micro piezo print heads feature microscopic piezoelectric actuators that are built behind the print nozzles. When an electrical charge is applied to them, the piezoelectric elements bend backward, drawing precise amounts of ink from the ink chamber into the firing chamber. When the electrical pulse is reversed, the piezoelectric elements bend the opposite way very rapidly, propelling the ink out of the nozzles at high speed. Micro piezo technology is able to precisely eject ink droplets of up to five different sizes by controlling minute variations in the charge applied to the piezoelectric actuators of the print heads.

UV system 2 includes a UV source. In the embodiment shown in FIG. 1, the UV source is UV bulb 4, which can generate UV irradiance. UV bulb 4 is a UV LED lamp. UV bulb 4 is partially surrounded by mirrors, including side mirror 5*a*, following mirror 5*b*, and angled mirror 5*c*, which cooperate to direct the UV irradiation from UV bulb 4. As shown in FIG. 1, radiation is able to pass undeflected directly towards substrate 6. Side mirror 5*a* redirects that portion of the UV irradiation from UV bulb 4 that would be incident on a portion of substrate 6 that is perpendicular to the print direction and the following direction along the surface of substrate 6. Likewise, following mirror 5*b* redirects that portion of UV irradiation 8 from UV bulb 4 that would be incident on a portion of substrate 6 that is beyond a certain distance in the following direction from print head 1. Likewise, a print direction mirror (not shown) can be employed to redirect that portion of UV irradiation 8 from UV bulb 4 that would be incident upon a portion of substrate 6 that is beyond a certain distance in the print direction from print head 1.

In alternative embodiments, UV system 2 may include more than one UV source. For example, UV system may comprise two UV LED lamps, positioned in the following direction from associated print nozzles.

The effect of side mirror 5*a*, following mirror 5*b*, and/or a print direction mirror (not shown) is to intensify the dosage of UV irradiation 8 that is incident upon recently printed UV-curable ink from print nozzles 3. By preventing the diffusion of UV irradiance 8 from UV bulb 4, more curing is possible on each pass of print head 1. In the embodiment shown in FIG. 1, print nozzles 3 are capable of dispensing a range of quantities of ink from 1.5-21 pL.

UV bulb 4 is not as wide as print head 1. In order to ensure that all of the UV ink dispensed by print nozzles 3 is at least "pinned," or cured sufficiently to prevent undesirable running or bleeding, angled mirror 5*c* is employed to extend the area cured by UV bulb 4. Angled mirror 5*c* is angled compared to side mirror 5*a* and following mirror 5*b*. In particular, angled mirror 5*c* extends at an angle that does not deflect as much UV irradiation 8 as is deflected by side mirror 5*a* or following mirror 5*b*. Thus, UV irradiation 8 is predominantly redirected towards those targets 7 over which UV bulb 4 would not otherwise pass during one printing pass.

Target 7 is the location where UV ink from ink nozzles 3 falls upon substrate 6. Each nozzle 3 is associated with a separate target 7, though only one target 7 is pointed out particularly in FIG. 1. As shown in FIG. 1, angled mirror 5*c* is angled to redirect a portion of UV irradiance from UV bulb 4 to the target 7 associated with each of nozzles 3. In this way, UV curable inks that fall on each target 7 is polymerized during the same pass. Thus, the viscosity and/or other rheological properties of a UV ink at target 7 are modified before the ink has the ability to wet out across substrate 6.

In operation, print head 1 moves along the print direction. During the movement of print head 1, UV system 2 emits UV irradiation that is focused and directed by the mirrors 5*a*-5*c*. UV curable ink dispensed from nozzles 3 is exposed to irradiance from UV bulb 4 immediately after contact with substrate 6 at target 7. Side mirror 5*a* and following mirror 5*b* cooperate to intensify the dosage of UV irradiance 8 that is incident upon the UV curable ink that is dispensed onto targets 7 that UV bulb 4 passes directly over. Furthermore, angled mirror 5*c* directs a portion of UV irradiance 8 towards those targets 7 that UV bulb 4 does not pass directly over. In this way, all of the UV ink is at least pinned. Immediate curing (at least pinning or partial curing) provides for greater dot height on each pass of print head 1, as well as greater accuracy of dot placement.

Because UV irradiation 8 is intensified by side mirror 5*a* and following mirror 5*b*, print nozzles 3 can dispense large quantities of UV curable ink onto targets 7. Print head 1 can be configured, for example, to print "inline" Inline printing may consist of first printing out a white base from those print nozzles 3 that are arranged furthest in the print direction. The white base may be a textured layer, such as the base of a Braille sign. A second set of print nozzles 3 that are arranged closer to the following direction can then print colored UV curable ink on the textured layer. All of the dispensed ink can then be cured as UV system 2 passes over the targets 7 that were just printed to. This process can be completed in a single pass. A second pass (or additional passes) of print head 1 may be used to add height or additional color or features.

In alternative embodiments, the nozzles 3 may be configured in the opposite way; that is, those print nozzles 3 arranged furthest in the print direction may dispense colored ink (e.g., black ink or a multitude of colors) in order to set up the base, textured portion, and the print nozzles 3 that are arranged furthest in the following direction may be used to print white ink over that. In either case, because of the intensity-increasing effect of mirrors 5*a*-5*b*, and the extension of range of angled mirror 5*c*, cure or pin all of the dispensed UV curable ink. Additional inline printing methods are described in more detail with respect to FIG. 6.

Thus, the orientations of side mirror 5*a*, following mirror 5*b*, and angled mirror 5*c* facilitate printing Braille signage with very few passes. For example, in one exemplary system, print head 1 may be used to produce a sign having pictograms and/or text that are a minimum of 0.079375 cm. (0.03125 in.) in height and Braille that is between 0.0635-0.09398 cm (0.025-0.037 in.) in height, using only two passes of print head 1 over substrate 6. In other exemplary systems, this level of height and precision, or other levels of height and precision defined by laws of other countries or regulations of other governing associations, may be achieved with different numbers of passes.

Figure 2:
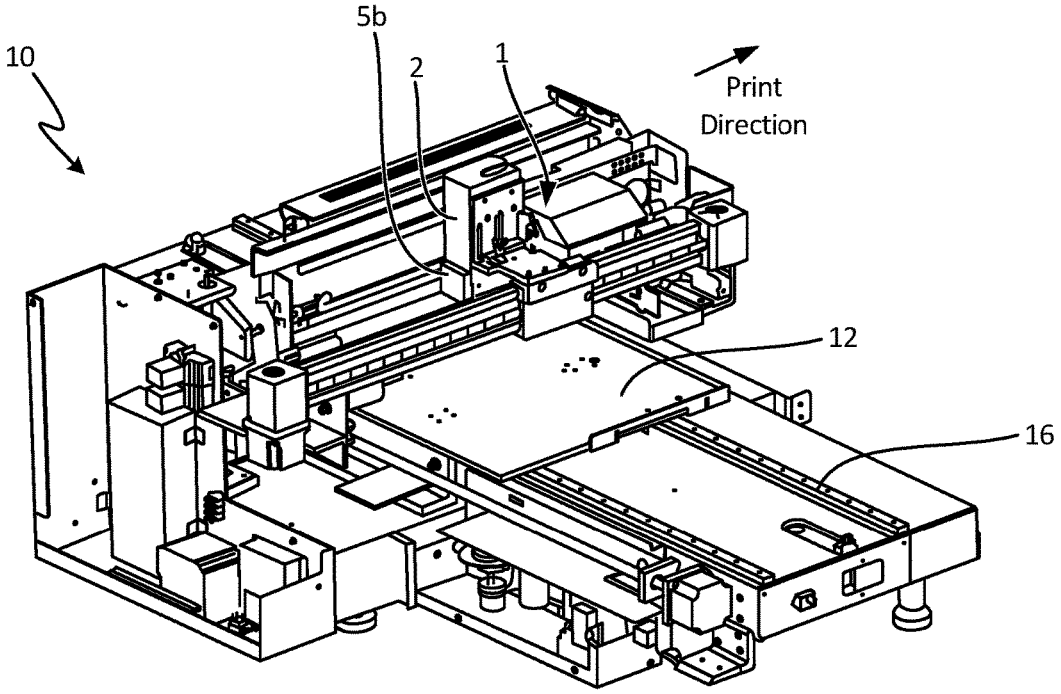
FIG. 2 is a perspective view of an inkjet printer, showing the UV LED lamp and print head.

FIG. 2 is a perspective view of inkjet printer 10. FIG. 2 shows the implementation of print head 1 within an inkjet printer 10. In addition to the components previously described with respect to FIG. 1, inkjet printer 10 includes table 12 positioned on rails 16.

Print head 1 is movable relative to the rest of inkjet printer 10 both away from table 12 and across table 12 (i.e., perpendicular to rails 16). Because both table 12 and print head 1 are movable relative to the rest of inkjet printer 10, inkjet printer 10 can be controlled to modify the position of table 12 and height of print head 1 from table 12. Print head 1 may be set to a standard height above substrate 6. In the embodiment shown in FIGS. 1-2, print head 1 is maintained at a distance of 0.1016 cm. (0.040 in.) above the most recently printed layer (or substrate 6, if no layer has yet been printed). This allows successive print layers to be printed on top of each other while retaining the necessary 0.1016 cm. (0.040 in.) clearance between print nozzles 3 and target 7. In other embodiments, alternative clearances may be provided, based on the configuration of the print head installed in the printer. UV system 2 is arranged on the following direction of print head 1, as previously described.

A UV LED ink curing process and various other control features necessary for multi-layer printing operation, including the control of registration repeatability, can be controlled. For example, the print engine sub-system may consist of a standard photo quality printer control system and components capable of resolutions ranging from 360 DPI up to 5760 DPI. Inkjet printer 10 may dispense a single layer or multiple layers of ink onto print media.

Inkjet printer 10 of FIG. 2 may be calibrated by the following method. First, the print table position is registered, which may be achieved while the printer is in Local Mode by an operator pressing the Print Home Key on the printer's keypad (not shown). The print engine interface board firmware algorithm receives this key command and then drives the table motor system while monitoring data related to print table position (e.g., the datum described with respect to FIG.

2). This data may be used to put the printer into a Print Home position, within a desired accuracy (e.g., ±0.00254 cm. (0.001 in.)). After the print engine interface board places the print table into Print Home position then the Print Engine Interface board firmware algorithm automatically switches over to Print Engine Mode where the firmware algorithm then allows the Print Engine access to the printer's table motor and encoder resources. At this time the operator would initialize the elevator to start position by pressing the Down Arrow key on the printer's keypad to which commands the print engine interface boards to drive the elevator motor to initial level where the print head is 0.1016 cm. (0.040 in.) above the media. To do this the print engine interface system uses a set of calibrated photo-electric thru-beam sensors to sense the position of the top of the print Media. This creates the necessary initial print head height registration point for the first layer pass height above the printer table. Now the printer system is ready to start a print. At this time the operator can send a print job from the operator's computer. After the multi-layered print job is sent to the printer the print engine interface system(s) firmware continually monitors the printer's position and after completion of each printed layer the firmware automatically switches back into Local Mode operation, which then brings the print table position back into the Print Home position, while also automatically readjusting the print head height so the print head is again 0.1016 cm. (0.040 in.) above the newly printed layer. This auto adjusting head height control scheme allows successive print layers to be printed on top of each other while retaining the necessary 0.1016 cm. (0.040 in.) clearance between the print head and table 12 and printed media.

A second method of using inkjet printer 10 of FIG. 2 varies from the first in that when the print engine interface board firmware algorithms receive the Print Home key command the firmware algorithms return to the Print Home position by first driving table 12 past the Right Limit (RL), Print Home (PH), Paper Edge (PE), then into the Left Limit (LL) sensor, then reverses the motor and drives it at a slower rate back into the PE sensor, then clears the table back out of the PE sensor and stops. Now the printer is in the Media Home position. The PE sensor has an accuracy of +/−0.00254 cm. (0.001 in.). Use of the encoder positioning feedback and quadrature detection with the print engine interface system allows table repeatability accuracy of 0.00254 cm. (0.001 in.) and monitoring of the table position to within 0.00022 cm (0.0000868 in.).

After calibration, inkjet printer 10 can print using print head 1, which contains a UV lamp and is precision controlled by the print engine interface as previously described. Print head 1 is positioned so that the UV lamp of print head 1 polymerizes UV curable ink dispensed therefrom during the printing process, as described in more detail with respect to FIG. 6.

In alternative embodiments, print head 1 may be kept stationary and table 12 may be moved instead. In fact, movement of one, the other, or both of print head 1 and table 12 are possible, so long as there is relative movement of print head 1 to table 12 that permits for dispensing and curing UV ink in a satisfactorily precise manner.

Figure 3:
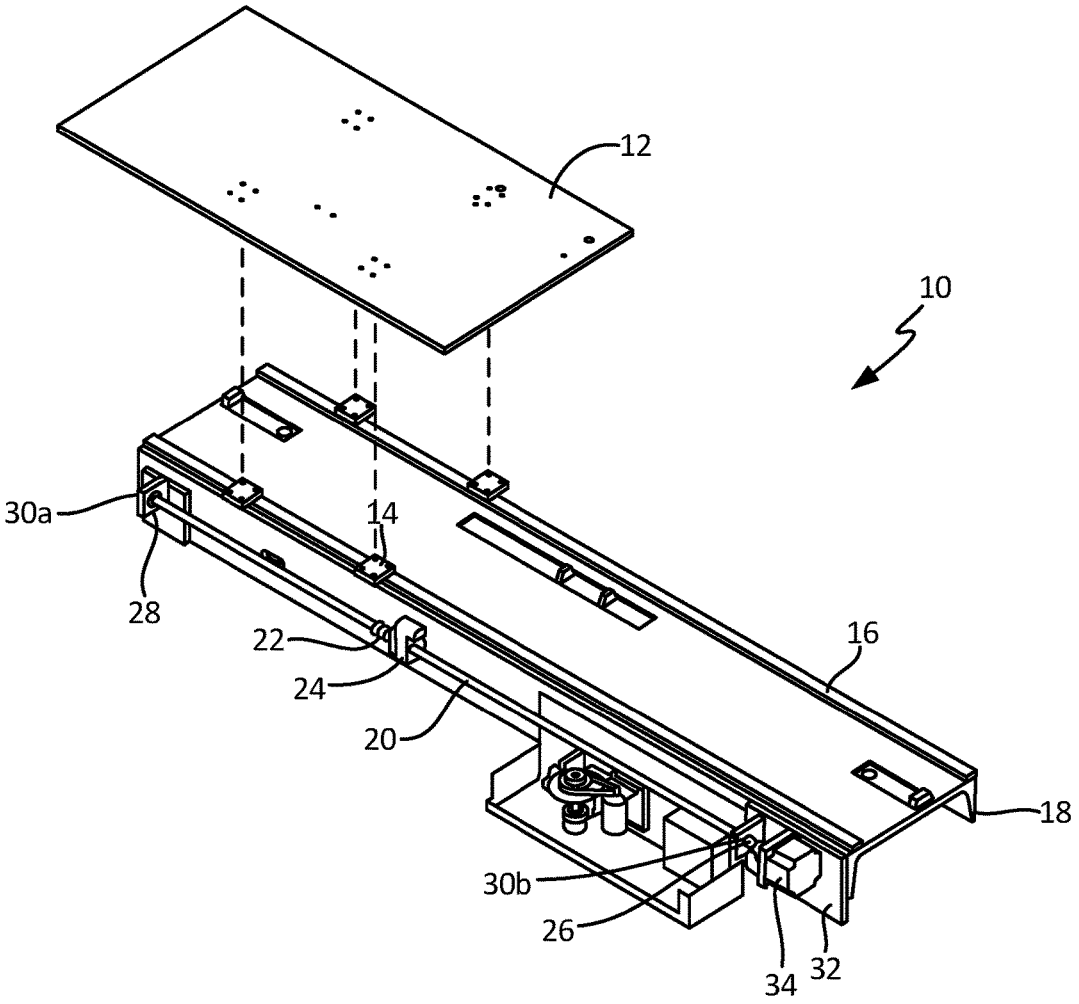
FIG. 3 is an exploded perspective view of an inkjet printer table drive mechanism.

FIG. 3 is a perspective view of inkjet printer 10. Inkjet printer 10 is a printer capable of generating printed ADA-compliant signs, such as Braille signs. Although ADA rules are subject to change, generally these rules require minimum standards regarding such signs, including materials and sizes of signs. For Braille signs, other standards may include dot height or dot spacing. Inkjet printer 10 is capable of printing with high accuracy, to exceed all the minimum standards in place as of Feb. 4, 2014, and to do so using a low number of printing passes. By reducing printing passes, the accuracy of inkjet printer 10 is increased at the same time that printing speed of signage is reduced.

Inkjet printer 10 includes table 12, linear cars 14, rails 16, base beam 18, lead screw 20, anti-backlash screw threaded nut 22, screw mount block 24, lead screw drive end 26, roller ball bearing 28, support blocks 30*a* and, drive sub plate 32, and motor 34.

Table 12 is shown in exploded view, removed from the other components that make up inkjet printer 10. In the embodiment shown, table 12 is a precise aluminum cast jig plate with a complete surface flatness less than 0.025 cm (0.010 in) and a dimensional square tolerance less than 0.005 cm (0.002 in). This allows printed media to be positioned flat and square to a print head (e.g., print head 1 of FIG. 1). Linear cars 14 are configured to be secured to table 12, and each of linear cars 14 is free to move parallel to one of rails 16 to which it is attached. In the example shown in FIG. 2, there are four linear cars 14.

In operation, linear cars 14 generally do not have any head space under the four points of contact with table 12, as shown in FIG. 2. Linear cars 14 may be adjusted along rails 16 to define a datum corresponding to the position of table 12 relative to rails 16.

Base beam 18, which may be made of a relatively inflexible material such as Aluminum, is aligned with rails 16 and is mounted to be substantially flat, and aligned to each other within the desired tolerance in all directions.

Table 12 is driven via lead screw 20 and anti-backlash lead screw threaded nut 22. Anti-backlash lead screw nut 22 is a three prong spring loaded split nut to accomplish anti backlash by eliminating thread space engagement. Anti-backlash lead screw threaded nut 22 may be adjusted so that it is centered with lead screw 20 throughout its length of travel. Lead screw 20 is parallel to rails 16, and rails 16 are parallel to one another, within dimensional tolerances determined by the desired finished printed product.

Anti-backlash lead screw threaded nut 22 is positioned in screw mount block 24, which has a dimensional square tolerance less than the desired printing tolerance previously described with respect to FIG. 1 (e.g., 0.005 cm. (0.002 in)). Screw mount block 24 is attached to the bottom surface of table 12.

Lead screw drive end 26 is configured to be driven by motor 34. On the opposite end of lead screw 20 from drive end 26, lead screw 20 is arranged on roller ball bearing 28, allowing free rotation of lead screw 20.

Support blocks 30*a* and 30*b* hold lead screw 20 and include roller ball bearings pressed into common bearing supports. Support blocks 30*a* and 30*b* are attached to drive sub plate 32 and on the idler end of inkjet printer 10. Dimensional tolerances are set as appropriate so that tolerance stackups do not affect the alignment of the parallelism of lead screw 20 with rails 16.

Drive sub plate 32 is coupled to rails 16 via base beam 18. Furthermore, drive sub plate 32 provides support for motor 34.

When motor 34 is driven, lead screw 20 is caused to rotate. Table 12 is coupled to lead screw 20 via screw mount block 24. Thus, when lead screw 20 is driven, table 12 will move along rails 16.

In alternative embodiments, additional rails 16 may be used and adjusted so that no more than 20% variance of measured drag is experienced throughout the travel distance of aligned table 12 mounted to four linear cars 14 which are in turn mounted onto rails 16. One of rails 16 may be mounted to determine the positional datum first, then a second rail 16 may be mounted such that the measurement from the datum to be aligned is within a desired tolerance. For ADA-compliant signage, for example, a tolerance of 0.013 cm (0.005 in.) may be used to ensure necessary accuracy of signage printed by inkjet printer 10.

Inkjet printer 10 provides a highly accurate work surface (table 12) that may be translated along one axis while providing a datum representative of the position of the work surface.

Figure 4:
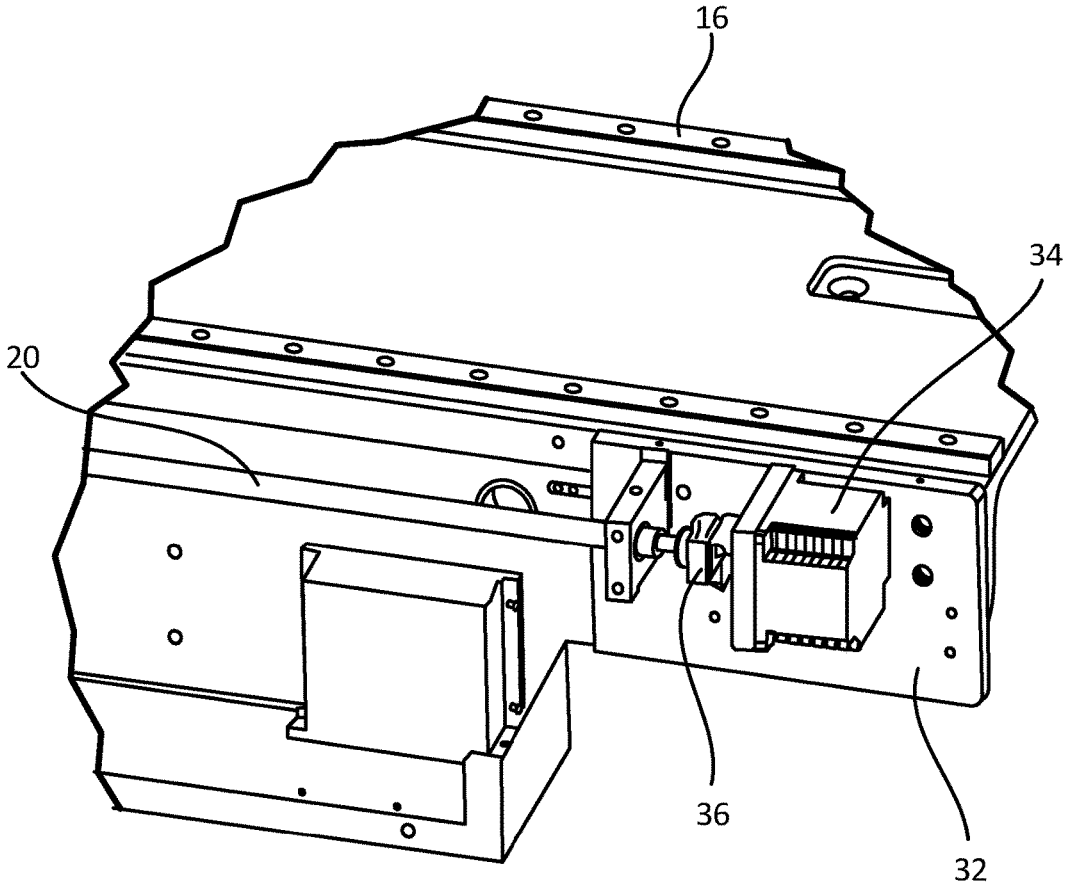
FIG. 4 is a cutaway perspective view of the drive mechanism for a printer table.

FIG. 4 is a cutaway perspective view of the drive mechanism for table 12 (FIG. 3), including motor 34. In the embodiment shown, motor 34 is a stepper motor, and is mounted to drive sub plate 32. Motor 34 may be a relatively high torque motor, using Bipolar holding torque, capable of imparting 125 ounce inches-200 ounce inches. Motor 34 connects to lead screw drive end 26 (FIG. 3) via flexible coupling 36. Motor 34 is controlled by a stepper driver control unit, which is signaled by printer following subassembly described in more detail with respect to FIG. 5 to accurately drive lead screw 20 and, by extension, table 12 of inkjet printer 10.

Figure 5:
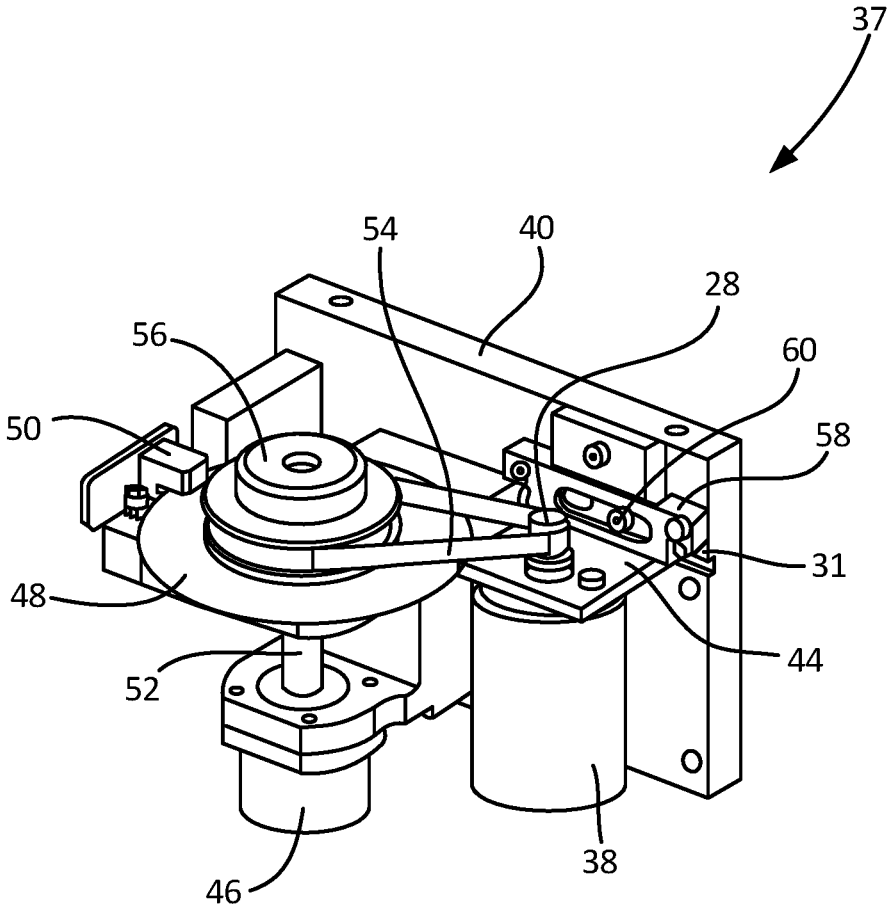
FIG. 5 is a partial perspective view of a printer following subassembly.

FIG. 5 is a detailed partial perspective view of printer following subassembly 37. Printer following subassembly 37 includes mechanical sub plate frame 40, print engine DC motor 38, adjustable mount 44, brake 46, encoder disc 48, encoder sensor 50, shaft 52, timing belt 54, timing pulley 56, locking plate 58, and screws 60.

Mechanical sub plate frame 40 is a stable mounting platform for the other components of printer following subassembly 37. Print engine DC motor 38 is mechanically coupled to mechanical sub plate frame 40 via adjustable mount 44.

Brake 46 is a magnetic brake. While brake 46 as shown in FIG. 5 is magnetic, in other embodiments alternative brake mechanisms known to those of skill in the art may be used.

Encoder disc 48 is a rotatable disc that passes through a sensing region of encoder sensor 50. Encoder disc 48 is mounted to encoder shaft 52, which is supported by two ball bearings (not shown). In the embodiment shown in FIG. 5, shaft 52 runs true with a tight tolerance run-out of less than 0.0005". In alternative embodiments, shaft 52 may have other tolerances sufficient to ensure a desired level of accuracy. Brake 46 is capable of adding a specific drag to stop encoder shaft 52.

Encoder shaft 52 is driven by timing belt 54. Timing pulley 56 is mounted on encoder shaft 52, adjacent to encoder disc 48. Timing pulley 56 is connected to motor 38 via timing belt 54. Adjustable mount 44 may be adjusted to modify the tension of timing belt 54. The angle and position of adjustable mount 44 is adjusted with screws 60. Screws 60 may be adjusted to move overlapping lock plate 58. Overlapping lock plate 58 can be adjusted to move adjustable mount 44 when screws 60 are loose, resulting in a change in both position and angle of DC motor 38, as desired.

Figure 6:
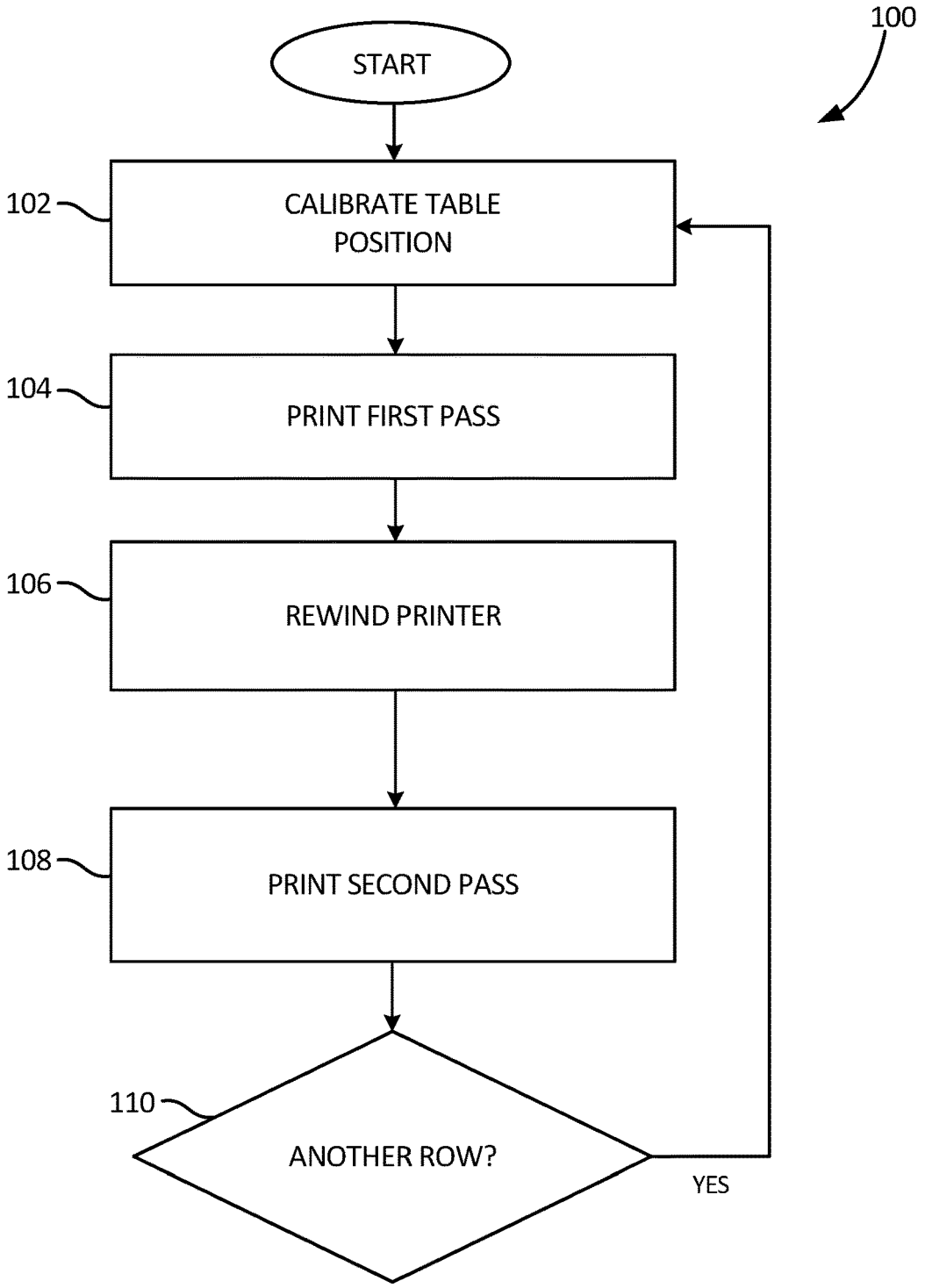
FIG. 6 is a flowchart of a method for using a UV printer.

FIG. 6 is a flowchart of a method for printing with a UV curable ink. At step 100, the print procedure is developed. Design software and raster image processing software communicate with the printer that prints the ADA compliant sign.

The process begins with the design of the sign. According to one embodiment, the process uses an ADA design module, where the user can create ADA compliant Text and Braille. In alternative embodiments, various design modules may be used that correspond to other printing specifications. There are options for; raised text, visual text, visual with raised text and Braille only. Once the text and Braille components are complete the pictogram can be imported, or designed by the user. After the design is complete a priming function is used to distinguish between the variations in height of the pictogram, text and Braille. These different components have different height requirements. The default settings will produce a sign with a Pictogram and Text that are a minimum of 0.079375 cm (0.03125 in.) in height and Braille that is between 0.0635-0.09398 cm (0.025-0.037 in.) in height. In other embodiments, alternative minimum and maximum heights may be defined by the laws of other countries or the regulations of other governing associations.

After the design of the sign is complete, the setup menu allows the user to control the trapping and bleeding of the different layers of the image. This insures that there is no color but the one that is printed in the final layer showing on the sign. The trap and bleed values can easily be changed to achieve different widths.

The file is then sent to the RIP (Raster Image Processing) software. The file is received as a .PS (postscript) file. Postscript files have the ability to handle line-art which makes the processing time from the design software to the RIP almost instantaneous, cutting down on overall workflow time. The RIP uses a Queue based system which categorizes the different file qualifications. There are separate Queues for ADA printing. These Queues have a very specific set of parameters; while the user has the ability to manipulate the job further, none are necessary.

The ADA queue is set up to print two layers or passes (e.g., with printer 10 as previously described), with an automatic rewind of the flat-bed table between the passes. Vertical offsets, which change the y-axis start points, are used to account for the variations between a standard 2880×1440 print (first pass) and an inline 1440×1440 print (second pass). The layer profile feature keeps the process simple, multiple printer settings can be chosen on different layers and therefore the software only requires one image to be sent. The layer profile will do the layer breakdown interpretation from that point forward. If additional graphics are desired the user can perform other passes to do so.

At step 102, table position is calibrated. As previously described with respect to FIGS. 1-4, this can be accomplished using an encoder sensor and a series of calibration procedures.

At step 104, a first layer of ink is applied. The ink dispensed in this first pass may, for example, be strictly intended for building height. Variable dot profiling can be turned off, allowing for the maximum amount of ink to jet from the piezo-electric ink jet dispensers. Through the use of separation curves, the amount of ink volume is precisely controlled and can be easily adjusted to produce a variation in height. This layer can print in both a uni-directional (left to right) mode or a bi-directional mode. Often, the first pass comprises inline printing; that is, those nozzles positioned furthest upstream on the print head dispense sufficient ink to form the desired printed texture, for example including raised dots or platforms. Nozzles that are positioned further downstream dispense a top coating over the printed texture, such as a white priming layer.

At step 106, the printer is reset for a second pass, as previously described with respect to step 100.

At step 108, a second pass is used to print additional UV curable ink. The overall height of the ink applied in the second pass may vary. For example, a second layer can be printed at a resolution of 1440×1440 Bi-Directional and covers all areas with the desired color. Bi-Directional printing greatly increases throughput time. Also, Bi-Directional printing with a higher head height allows for the CMYK to cover both sides of the high first layer. Only a small amount of clear ink is used in the second pass to help with surface cure but keep the gloss level down at the same time. During the second pass, a smaller quantity of UV curable ink can be dispensed from each of the print nozzles. In this way, a rough approximation of the finished product can be generated in the first pass (i.e., step 104) and more detailed work can be done during the second pass (i.e., step 108). This allows printing at the resolution needed for fine detail and/or accurate color rendering.

As previously described with respect to step 104, the first pass can utilize inline printing to form a desired printed texture, which is covered by a background color ink. In that case, the second pass may be used to further increase the height of textured areas, and/or to add a desired color selectively. For example, textured areas that correspond to raised text on a sign may have a color added to them, or Braille dots that were created in the first pass may have an ink with a desired texture printed on top.

At step 110, the next row is printed, if required. This generally requires moving the print head relative to the table in the direction perpendicular to what has heretofore been referred to as the print direction. In this way, additional rows of raised printed material may be created. Some overlap of the rows may be present, for example to ensure any pinned UV ink is fully cured. Upon moving to the new row, the table position and print head position are re-calibrated at step 102 and the process continues until the desired sign is complete.

Although the printing processes described above are generally explained in relation to printing in two passes, it should be understood that the printing processes may be achieved in a single pass or in three or more passes in other embodiments, by either eliminating the second pass, or by repeating the passes multiple times.

Figure 7:
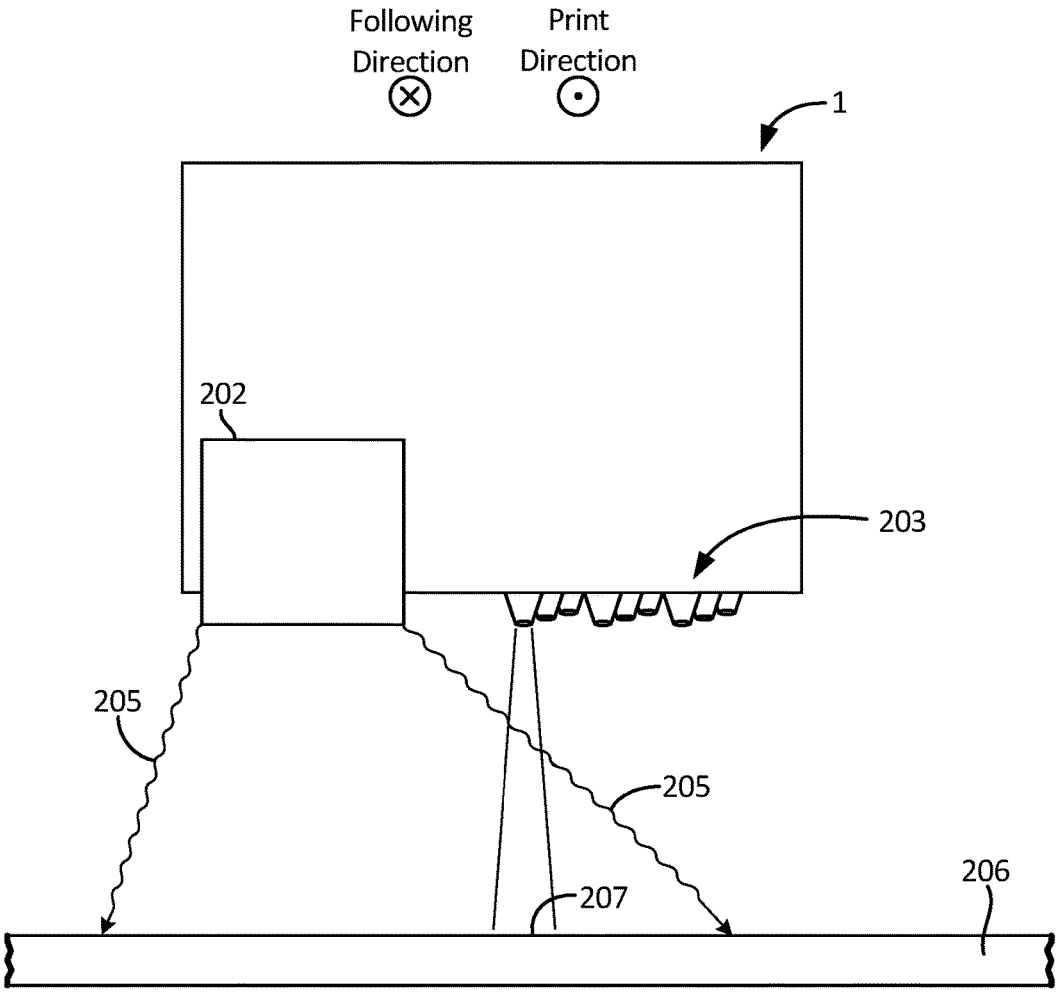
FIG. 7 is a schematic cross-sectional view of an inkjet printer according to another embodiment.

FIG. 7 is a schematic cross-sectional view of print head 201, including UV curing system 202 and print nozzles 203, according to another embodiment. Print head 201 is arranged above substrate 206, such that nozzles 203 are configured to deliver ink to target area 207 on substrate 206. Print head 201 is similar to print head 1 shown in FIG. 1 and described above, except that UV curing system 202 of print head 201 employs at least one UV light source that has a sufficiently wide UV field and intensity of UV irradiance 205 to achieve at least "pinning" (sufficient curing of ink to prevent undesirable running or bleeding) in target area 207, without employing any physical mirrors or reflectors. Each print nozzle 203 is associated with a separate target 207, though only one target 207 is pointed out particularly in FIG. 7 for convenience of illustration—UV curing system 202 is designed to provide a curing intensity of UV irradiance to all of the targets associated with print nozzles 203. As discussed above with respect to print head 1 shown in FIG. 1, print head 201 can be used to generate printed materials such as ADA-compliant and/or Braille signage. Print head 201 is capable of producing signage with accurate dot spacing, using a controlled number of passes to create a desired height.

Figure 8A:
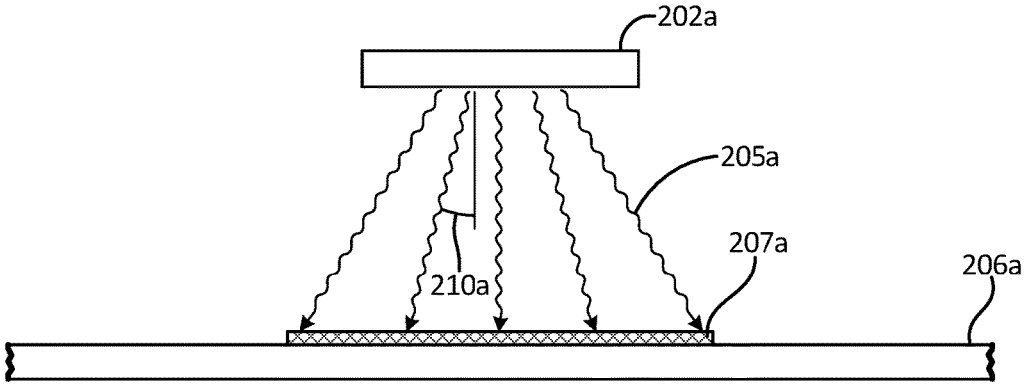
FIGS. 8A and 8B are diagrams illustrating relative sizes of UV curing systems and target curing areas in various embodiments.
Figure 8B:
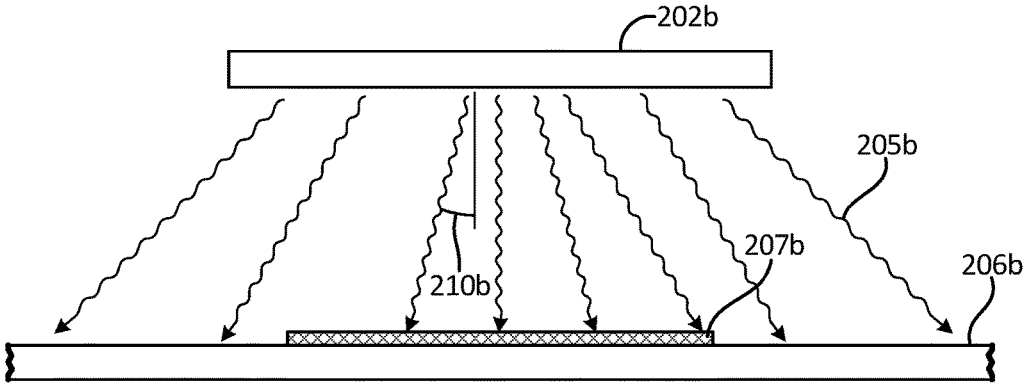

The relative size of UV curing system 202 and of the extent of a target width that is cured by the UV radiation field produced thereby may vary. FIG. 8A is a diagram illustrating a first embodiment, in which UV curing system 202*a* has an emitting area that is smaller than target width 207*a*. In this embodiment, UV curing system 202*a* is designed to emit UV irradiance 205*a* with a dispersion angle 210*a* that is sufficient to provide UV irradiance 205*a* in a field having a width that covers target width 207*a* on substrate 206*a*, with sufficient intensity to achieve at least a "pinning" level of curing of dispensed ink in target width 207*a*. FIG. 8B is a diagram illustrating a second embodiment, in which UV curing system 202*b* has an emitting area that is larger than target width 207*b*. In this embodiment, UV curing system 202*b* is also designed to emit UV irradiance 205*b* with a dispersion angle 210*b* that is sufficient to provide UV irradiance 205*b* in a field having a width that covers target width 207*b* on substrate 206*b*, with sufficient intensity to achieve at least a "pinning" level of curing of dispensed ink in target width 207*b*. As will be appreciated by those skilled in the art, the larger dispersion angle of the UV irradiance 205*a* emitted in the first embodiment is larger (that is, the radiation is more widely dispersed) than that in the second embodiment, and it is possible to design UV curing systems 202*a* (FIG. 8A) and 202*b* (FIG. 8B) to ensure that the desired width and intensity of UV irradiance is delivered to the target region. With any appropriately designed UV curing system as shown in FIGS. 8A and 8B, the same precision and height of printed features may be achieved as was described above.

In one particular embodiment, the emitting window of the UV curing system may be 20×28 mm, and may be located 7 mm from the surface of the substrate being printed. In another particular embodiment, the emitting window of the UV curing system may be 25×10 mm, and may be located 1.5 mm from the surface of the substrate being printed. Other sizes and heights of the emitting window of the UV curing system are possible in other embodiments, depending on the application for which the printing system is to be used.

The location of the UV curing system with respect to the nozzles of a print head may vary in different embodiments. For example, in the embodiment shown in FIG. 7, UV curing system 202 is shown in a location that is offset from nozzles 203 of print head 201 (and therefore is offset from target area 207 as well). In the embodiments shown in FIGS. 8A and 8B, UV curing systems 202*a* and 202*b* are shown in locations that are directly over target areas 207*a* and 207*b*, respectively, indicating that UV curing systems 202*a* and 202*b* are located in the same printing line as the nozzles of the print heads. The print heads may also be configured in some embodiments with UV curing systems locating in front of and behind the nozzles of the print head, so that curing of ink dispensed by the nozzles can be performed when the print head moves relative to the substrate in both (opposite) directions. Movement of the print head relative to the substrate may be achieved by a system configured to move the print head, by a system configured to move the substrate, or both.

Figure 9A:
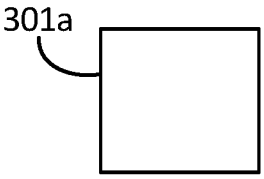
FIGS. 9A, 9B and 9C are diagrams schematically illustrating alternative embodiments of print head configurations.
Figure 9B:
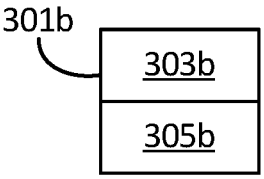
Figure 9C:
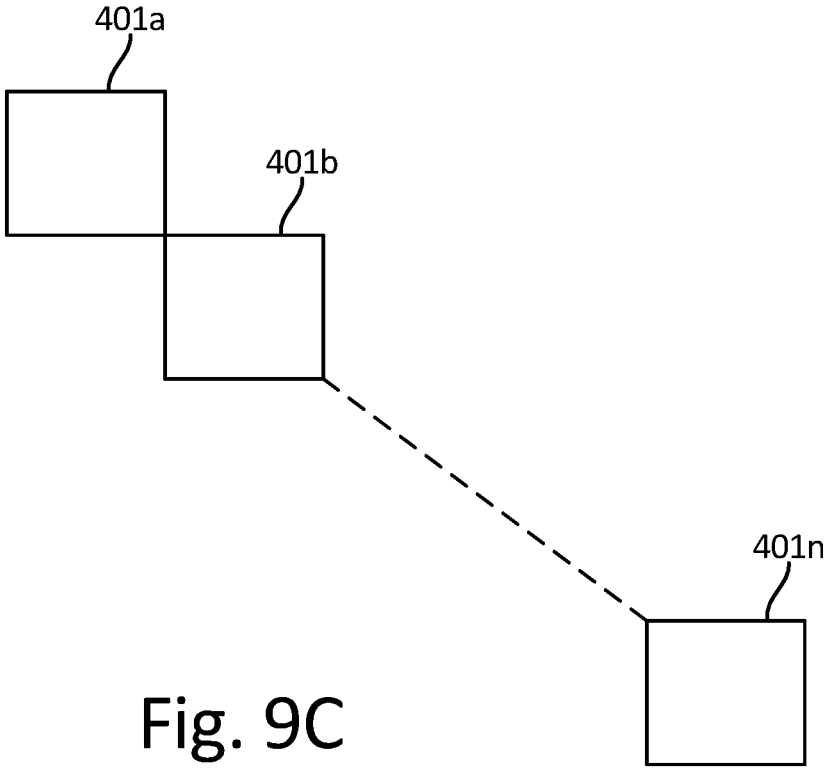

FIGS. 9A, 9B and 9C are diagrams schematically illustrating alternative embodiments of print head configurations. FIG. 9A illustrates print head 301*a*, in which a single housing carries nozzles and a UV curing system that function as a single print head unit. Print head 1*a* may have the configuration shown in FIG. 1 or FIG. 7, for example, with a single set of nozzles 3 or 203, and a UV curing system 2 or 202, respectively. However, in other embodiments, multiple print head housings that are ganged together may be employed in a printer, or multiple sets of nozzles may be provided on a single print head housing, or both. FIG. 9B illustrates print head 301*b*, in which a single print head housing is configured to carry multiple sets of nozzles that function as independent print head units 303*b* and 305*b*. In some embodiments, each of print head units 303*b* and 305*b* may have a separate UV curing system associated with them, while in other embodiments, print head units 303*b* and 305*b* may share a common UV curing system carried by print head 301*b*. In other embodiments, more than two independent print head units may be provided on print head 301*b*. FIG. 9C illustrates print heads 401*a*, 401*b* . . . 401*n*, which are shown schematically to illustrate the ganging of these print heads together in a printer system. Any number (n) of print heads may be ganged together in various embodiments, based on the application(s) for which the printing system is designed. Each of print heads 401*a*, 401*b* . . . 401*n* includes a set of nozzles and a UV curing system, similar to nozzles 3 or 203 and UV curing system 2 or 202 shown in FIGS. 1 and 7, respectively. The embodiments shown in FIGS. 9A, 9B and 9C may be used in various printer configurations to allow printing of signs in the manner generally described above with respect to FIGS. 1-6 in one pass or in multiple passes. In general, the embodiments employing multiple print heads or multiple print head units provide additional flexibility for achieving precise and complex printed features in a fewer number of passes, including printing in a single pass in some embodiments, or alternatively in a number of passes with less time being taken for each pass, due to the larger area that can be printed by the multiple print heads or print head units.

The number of passes used for the printing of a Braille sign may be selected based on the nature of the sign and the desired use of the printing system. For example, a sign to be printed may include a contrasting background, contrasting raised letters, and Braille dots. For a sign of this nature, it may be desirable to print the background, letters and dots in multiple passes. Alternatively, particularly for a system in which multiple ganged print heads are employed, it may also be possible to print such a sign in a single pass, using leading print heads to print the initial layer(s) and trailing print heads to print the subsequent layer(s), for example. Multiple passes may also be used in some applications to build up texture in an initial pass, with white and color being printed over the texture structure in subsequent passes. It should be understood by those skill in the art that the printing system disclosed herein allows for the number of passes to be selected, between one and three or more passes, while achieving the speed and accuracy needed for a number of printing applications.

In the description above, reference has been made to a number of "passes" in the process of printing a Braille sign. In the context of the present application, a "pass" refers to a complete traversal of all printable points of a substrate by the print head(s) of a printer. In some embodiments, the same point on the substrate may be traversed by the print head(s) multiple times during the same pass, such as by allowing the print head(s) to move across the width of the substrate in two opposite directions before stepping to the next row to be printed, or by employing multiple ganged print heads that each pass over the same point during a pass, for example.

Figure 10:
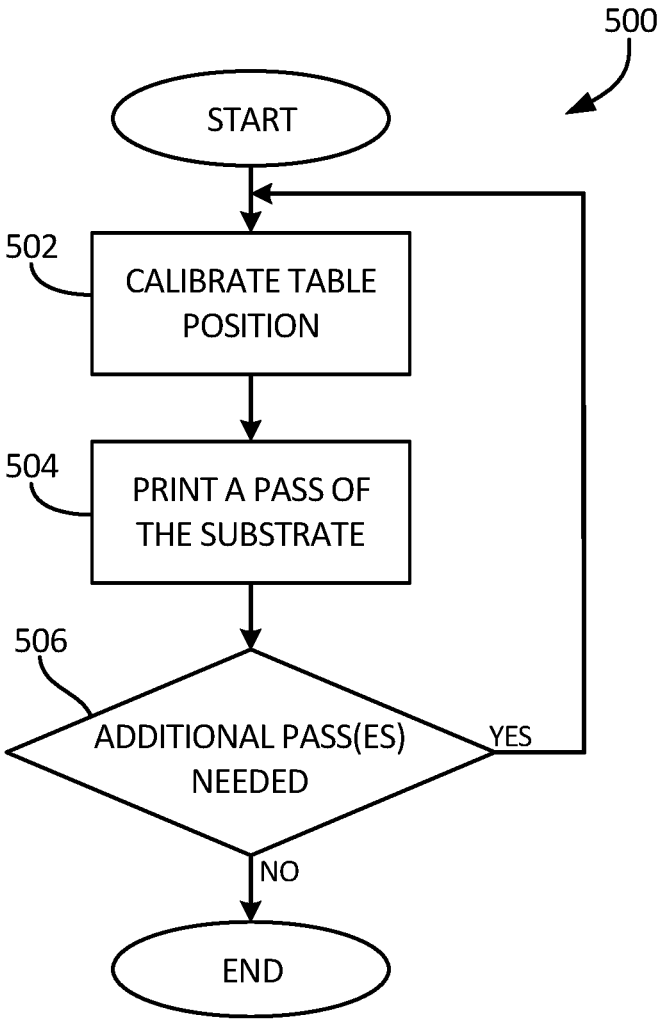
FIG. 10 is a flowchart of a method of printing a substrate using one or more passes.

FIG. 10 is a flowchart of a method 500 of printing a substrate using one or more passes. In method 500, the table position (relative to the print head) is first calibrated (step 502). Then, the printer prints a pass of the substrate (step 504). As has been described above, a pass may include multiple traversals of a point on the substrate by a print head, or may include traversal of a point on the substrate by multiple ganged print heads, in some embodiments. In some embodiments, a pass may involve dispensing a layer of ink on the substrate, so that subsequent passes build up the height of printed features to an ultimate desired feature height. In other embodiments, different passes may involve the dispensing of different parts of the printed features, such as a structural layer, one or more colored layers, etc. As described herein, each pass includes operation of a UV curing system to apply at least a pinning level of curing radiation to the dispensed UV-curable ink. After a pass has been printed, the printer is controlled with one or more instructions or control signal to indicate whether one or more additional passes are needed (step 506). If the printer is controlled to perform an additional pass, method 500 returns to step 502, where the table position is calibrated to prepare for the subsequent pass to be performed by the printer. If no additional passes are needed, printing is complete and the process ends.

In one particular embodiment, the UV curing system may provide a minimum power density of 4-6 Watts/cm$^2$, and the printing speed on the X axis for the print head (or for multiple print heads or print head units) may be 534 mm/second. In such a system, it is possible to fully print a 6 inch×8 inch sign with the Braille text "MEN" and an accompanying flat pictogram image, such as is standard for a restroom sign, with no background, in about 3 minutes and 40 seconds. Similarly, a 3 inch×2.675 inch room sign with a full color background and Braille text may be printed in about 54 seconds. The time that is needed to print a particular sign is based on a number of factors, including the intensity/power density of the UV curing system, the printing speed, the chemistry of the ink, the height and spacing of the features of the sign to be printed, and others. The configurations described herein provide a printing system with excellent speed and dot placement accuracy for a variety of applications.

While the majority of the description above refers to ADA-compliant and Braille signage based on standards set in the United States, it should be understood that the printing systems and methods described herein are applicable to achieve three-dimensional sign printing according to other standards around the world. For example, signs compliant with the requirements of the Building Code of Australia (BCA) may be printed using the system(s) and method(s) described above, which requires tactile characters to be raised 1.0-1.5 mm, and includes other requirements of size and spacing.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A printer comprising:

a table configured to hold a substrate;

an ink jet dispenser carried by a print head and configured to jet UV-curable ink onto the substrate in a target region; and a UV curing system configured to emit UV irradiance in a radiation field that covers the target region and provides sufficient intensity to at least pin the UV-curable ink in the target region.

2. The printer of claim 1, wherein the UV curing system is carried by the print head.

3. The printer of claim 2, wherein the encoder sensor is configured to generate a datum corresponding to the position of the substrate.

4. The printer of claim 1, further comprising:

an encoder sensor coupled to the substrate.

5. The printer of claim 1, wherein the ink jet dispenser is a piezo-electric dispenser.

6. The printer of claim 1, wherein the UV curing system comprises a UV source configured to emit UV irradiance with a dispersion angle that results in the radiation field having sufficient width to cover the target region.

7. The printer of claim 1, wherein the UV curing system further comprises:

a plurality of mirrors configured to deflect the UV irradiance from a UV source to direct the UV irradiance into the radiation field that covers the target region.

8. The printer of claim 1, wherein the ink jet dispenser is configured with a plurality of nozzles operable to dispense the UV curable ink onto a plurality of targets, and the UV curing system is configured to emit UV irradiance in the radiation field covering all of the plurality of targets to at least pin the UV-curable ink present at the targets.

9. The printer of claim 1, and further comprising a stepper motor configured to move the substrate along a rail.

10. The printer of claim 9, wherein the stepper motor is coupled to a lead screw, and the lead screw is coupled to the substrate.

11. The printer of claim 1, wherein the print head comprises a plurality of print head units each having ink jet dispensing nozzles configured to jet UV-curable ink onto the substrate in a respective target region.

12. The printer of claim 11, wherein each of the plurality of print head units includes a separate UV curing system configured to emit UV irradiance in a respective radiation field that covers the respective target region and provides sufficient intensity to at least pin the UV-curable ink in the respective target region.

13. A printer comprising:

a table configured to hold a substrate;

a plurality of print heads ganged together, each of the plurality of print heads comprising:

at least one ink jet dispensing nozzle configured to jet UV-curable ink onto the substrate in a respective target region; and a UV curing system configured to emit UV irradiance in a radiation field that covers the respective target region and provides sufficient intensity to at least pin the UV-curable ink in the respective target region.

14. A method of printing on a substrate, the method comprising:

formulating a print design procedure;

calibrating a position of the substrate relative to at least one print head, the at least one print head including an ink jet dispenser configured to jet UV-curable ink onto the substrate in a target region, and including a UV curing system configured to emit UV irradiance in a radiation field that covers the target region and provides sufficient intensity to at least pin the UV-curable ink in the target region;

dispensing at least a first pass of UV-curable ink from the ink jet dispenser onto the substrate in a pattern defined by the print design procedure while moving the at least one print head relative to the substrate; and emitting UV irradiance from the UV curing system to at least pin the UV-curable ink dispensed from the ink jet dispenser.

15. The method of claim 14, wherein emitting UV irradiance from the UV curing system comprises deflecting the UV irradiance with a plurality of mirrors toward the substrate in the radiation field to cover the target region of UV-curable ink dispensed by the ink jet dispenser.

16. The method of claim 14, wherein emitting UV irradiance from the UV curing system comprises operating a UV source configured to emit the UV irradiance with a dispersion angle that results in the radiation field having sufficient width to cover the target region of UV-curable ink dispensed by the ink jet dispenser.

17. The method of claim 14, wherein calibrating the position of the substrate relative to the at least one print head comprises generating a datum corresponding to the position of the substrate with an encoder sensor.

18. The method of claim 14, wherein multiple passes of the UV-curable ink are dispensed from the ink jet dispenser, with each pass of the multiple passes being followed by emitting UV irradiance from the UV curing system to at least pin the UV-curable ink dispensed from the ink jet dispenser.

19. The method of claim 14, wherein moving the at least one print head relative to the substrate comprises moving the at least one print head while the substrate remains stationary, or moving the substrate while the at least one print head remains stationary.

* * * * *